US008001978B2

(12) United States Patent
Mehio

(10) Patent No.: US 8,001,978 B2
(45) **Date of Patent: *Aug. 23, 2011**

(54) SMOKING APPARATUS

(75) Inventor: Nizar Youssef Mehio, Tallet El Khayet (LB)

(73) Assignee: Mya Saray, LLC, Sterling, VA (US)

( * ) Notice: Subject to any disclaimer, the term of this patent is extended or adjusted under 35 U.S.C. 154(b) by 190 days.

This patent is subject to a terminal disclaimer.

(21) Appl. No.: 11/201,289

(22) Filed: Aug. 11, 2005

(65) Prior Publication Data

US 2006/0272658 A1 Dec. 7, 2006

(51) Int. Cl.
*A24F 1/14* (2006.01)
*A24F 1/30* (2006.01)

(52) U.S. Cl. ..... 131/173; 131/221; 131/229; 131/201; 131/207

(58) Field of Classification Search ..... 131/173
See application file for complete search history.

(56) References Cited

U.S. PATENT DOCUMENTS

| | | | | |
|---|---|---|---|---|
| 722,405 | A * | 3/1903 | Ganim | 131/173 |
| 3,805,806 | A * | 4/1974 | Grihalva | 131/173 |
| 3,918,464 | A * | 11/1975 | Kolodziej | 131/173 |
| 4,134,410 | A * | 1/1979 | Kahler | 131/173 |
| 5,908,531 | A * | 6/1999 | Laurent | 156/396 |

FOREIGN PATENT DOCUMENTS

DE 2004134 U1 * 5/2000

* cited by examiner

*Primary Examiner* — Richard Crispino
*Assistant Examiner* — Phu Nguyen
(74) *Attorney, Agent, or Firm* — General Counsel, P.C.

(57) ABSTRACT

An improved smoking apparatus includes a bottle containing a fluid. The bottle has an upstanding neck with peripheral collar formed around the external periphery thereof. A stem has a base and a neck. The base defines an interior plenum, and a passage extends through the neck and terminates at the interior passage. A burner cup is mounted to the stem in communication with the passage. The interior plenum has a size and shape to permit the stem to be coupled to the bottle by placing the base over the neck, with a bottom edge of the base resting on the collar of the bottle. A sealing element is disposed between the exterior surface of the neck of the bottle and the inner surface of the interior plenum to provide a substantially air-tight coupling.

14 Claims, 1 Drawing Sheet

SMOKING APPARATUS

BACKGROUND OF THE INVENTION

1. Field of the Invention

Figure 1:
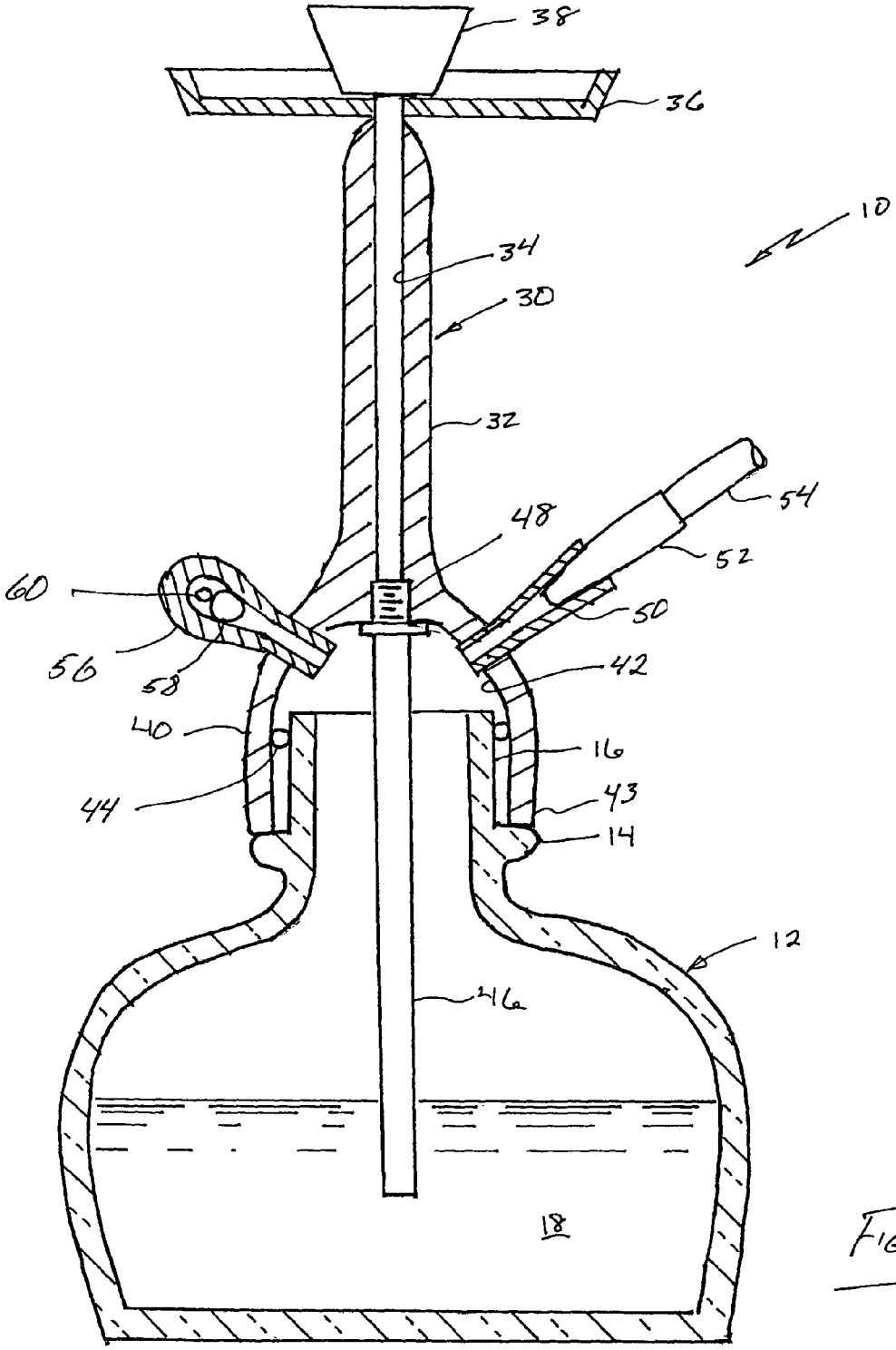

The invention relates to smoking apparatuses, such as a pipe, and more particularly to smoking pipes with blown-glass bases.

2. Description of the Related Art

Pipes are often used to smoke substances such as tobacco. Moisture from a fluid may be mixed with pipe smoke to ameliorate harshness and to impart a pleasant flavor or aroma to the smoke. So-called hookah pipes are one way in which smoke may be mixed with moisture.

A hookah pipe has a bottle which filled with fluid. The bottle of the hookah may be made of glass, such as crystal. A stem is mounted to the bottle. The stem includes a passage conveying smoke from a burner cup on top of the stem through a down tube projecting from the stem and into the fluid in the bottle. The stem is preferably made of metal. The smoke drawn through the stem is expelled from the down tube beneath the surface of the fluid and allowed to bubble up through the fluid to the surface, absorbing moisture as it rises to the fluid surface. The stem base defines an interior plenum into which smoke bubbling from the fluid surface collects. One or more smoking hoses are connected to the stem, in communication with the interior plenum. A user smokes the hookah by drawing smoke through the hose.

The bottle of a hubble-bubble is often made of blown glass. The stem of the hookah is mounted to a neck of the base, so the neck must be drawn out to a length and diameter commensurate with the dimensions of the metal stem and plenum during the glass blowing process. It may be difficult to control accurately the dimensions of the neck while the glass is being blown. Some of this variation of dimensions is attractive, and lends a unique, hand-crafted appearance to the base. Significant variations of dimensions can make coupling the stem to the neck with an air tight connection difficult. Typically a base of the stem is inserted or threaded into the neck of the bottle. The stem must fit inside the neck substantially tightly in order to prevent smoke from leaking. The longer the neck, the more likely the inner profile of the neck will vary from true roundness, and the less likely the stem will fit tightly.

SUMMARY OF THE INVENTION

The current invention is embodied in a smoking apparatus which includes a bottle containing a fluid, a stem coupled to the bottle, and one or more smoking tubes connected to the stem which permit users to draw smoke from a burner cup mounted to the stem, through the stem and the fluid contained within the bottle, and out of the tube.

The bottle has an upwardly-extending neck and a radially extending collar extending around the external periphery of the neck. The stem has a base and a neck extending upwardly from the base. The base defines an interior plenum having a size and shape that permits the base to be placed over the neck of the bottle with a bottom edge of the base resting on the collar.

BRIEF DESCRIPTION OF THE OF THE DRAWINGS

FIG. 1 is a smoking pipe according to the present invention shown in cross section.

DETAILED DESCRIPTION OF THE PREFERRED EMBODIMENTS

A smoking apparatus in the form of a hookah pipe indicated by reference no. 10 is shown in FIG. 1. The pipe 10 includes a bottle 12 containing a liquid 18 and a stem 30 mounted to the top of the bottle 12. The bottle 12 has an upper, generally cylindrical neck 16 and a radially extending peripheral shoulder 14 surrounding the neck beneath the upper end thereof. The bottle 12 may be formed from any suitable material such as glass, plastic, acrylic, ceramic, etc.

The stem 30 includes an upper neck 32 and a stem base 40. A burner cup 38 for holding the smoking material, such as tobacco, is mounted proximate a top end of the neck 32. Preferably a plate 36 is positioned beneath the burner cup 38 for catching ashes and other materials spilled from the burner cup 38.

The stem base 40 forms an interior plenum 42. The lower portion 43 of the base 40 has a shape, preferably circular, that conforms to the shape of the neck 16 of the bottle 12 and has a diameter sufficiently larger than that of the neck 16 so that the stem 30 can be operatively mounted onto the bottle 12 by merely placing the stem base 40 over the neck 16 so that the lower end 43 of the stem base 40 is seated on the collar 14 of the bottle 12. Preferably, a sealing element, such as o-ring 44 or other suitable gasket material, is placed over the neck 16 between the neck 16 and the inner surface of the stem base 40 to provide a generally airtight seal between the stem base 40 and the neck 16.

A passage 34 extends from the burner cup 38 through the neck 32. A down tube 46 is secured into the neck 32, preferably by a threaded end 48, in alignment with the passage 34. The down tube 46 extends from the interior plenum 42 into the bottle 12 such that it's lower-most and is beneath the surface of the liquid 18.

A hose fitting 50 extends into the stem base 40 and is preferably threaded thereto. A smoking hose 54 has a hose nipple 52 secured at an end thereof, and the nipple 52 is secured to the hose fitting 50 by forcing its tapered end into the tapered opening of the hose fitting as shown in FIG. 1.

The pipe 10 is smoked by a user drawing smoke through a mouthpiece (not shown) at an opposite end of the hose 54, thereby drawing air through the burner cup 38, through the passage 34 and down tube 46, through the liquid 18, up into the interior plenum 42, and through the hose fitting 50 and hose 54. Although not shown, the pipe 10 may include more than one hose fitting and attached hoses to permit multiple users.

Because the stem 30 is coupled to the bottle 12 by merely placing the stem base 40 over the neck 16 with o-ring 44 in place to provide a suitable seal, manufacturing tolerances of the neck 16 need not be so stringent. In addition, should the bottle 12 be broken, the stem 30 can easily be placed onto a second bottle having a neck of generally similar proportions.

A pressure release 56 extends into the stem base 40 and is preferably secured thereto by threading. The pressure release comprises a generally enclosed tab with an interior plenum including a tapered portion and a rounded end portion. A ball 58 is disposed within the interior of the pressure release 56 and a relief opening 60 is formed in the pressure release 56 into the interior portion thereof. During use of the pipe while a user is drawing smoke through the tube 54, the relative vacuum formed in the interior plenum 42 draws the ball 58 into the tapered portion of the interior plenum of the pressure release 56, thereby blocking any air passage through the pressure release 56. To equalize the pressure within the interior plenum 42 of the stem 30, the user need only blow slightly into the tube 54. The increased pressure created within the interior plenum 42 will cause the ball 58 to dislodge from the tapered portion thereby permitting airflow into the pressure release 56, around the ball 58, and out of the relief opening 60.

While various embodiments of the present invention have been described above, they should be understood to have been presented by way of examples only, and not limitation. Thus, the breadth and scope of the present invention should not be limited by the above described embodiments.

Modifications and variations of the present invention are possible in light of the above teachings. It is therefore to be understood that the invention may be practiced otherwise than as specifically described herein.

What is claimed is:

1. A hookah system comprising:

a hookah bottle having an upper neck with a substantially flush exterior, peripheral side surface and a hookah bottle opening;

a flexible seal disposed about said substantially flush exterior, peripheral side surface; and a hookah stem with a stem base defining an interior plenum comprising:

an interior sidewall having a substantially flush sidewall surface dimensioned to sealingly accept said flexible seal by compressing said flexible seal upon said substantially flush exterior, peripheral side surface of said neck upon placement of said stem onto said bottle neck;

an elevated wet smoke cavern above said hookah bottle opening and defined by said interior sidewall positioned above said compressed flexible seal for the direct accumulation of wet smoke from said bottle; and a wet smoke aperture defined by said interior plenum sidewall that directly accesses said wet smoke cavern and is adapted to accept a hose fitting.

2. The system of claim 1 wherein said flexible seal is removably disposed about the periphery of said neck.

3. The system of claim 1 wherein said wet smoke cavern includes a perimeter diminishing upwardly with respect to said bottle.

4. The system of claim 3 wherein said stem further comprises multiple wet smoke outlets, and multiple hose fittings in fluid communication with said multiple wet smoke outlet such that each wet smoke outlet allows the passage of wet smoke to a single hose fitting.

5. The system of claim 4 wherein said multiple hose fittings are removable hose fittings with a threaded portion.

6. The system of claim 1 wherein said bottle further defines a peripheral shoulder dimensioned to support said hookah stem.

7. The system of claim 1 further comprising a down tube, connected to said interior sidewall, passing through said wet smoke cavern and descending into said bottle.

8. The system of claim 7 wherein said down tube is releasably connected to said interior sidewall.

9. A hookah system comprising:

a hookah bottle having an upper neck with a substantially flush exterior, peripheral side surface, an interior side surface, and a hookah bottle opening;

a flexible seal disposed about said substantially flush exterior, peripheral side surface; and a hookah stem with a stem base defining an interior plenum comprising:

an interior plenum sidewall having a substantially flush sidewall surface dimensioned to sealingly accept said flexible seal by compressing said flexible seal upon said substantially flush exterior, peripheral side surface of said neck upon placement of said stem onto said bottle neck;

an elevated wet smoke cavern above said hookah bottle opening and defined by said interior plenum sidewall positioned above said compressed flexible seal for the direct accumulation of wet smoke from said bottle; and a wet smoke aperture defined by said interior plenum sidewall that directly accesses said wet smoke cavern and is adapted to accept a hose fitting; and a down tube, connected to said interior plenum sidewall, with a down tube exterior and passing through said wet smoke cavern and descending into said bottle, wherein space between said down tube and said interior plenum sidewall and space between said down tube and said inside neck surface define a substantially annular wet smoke ascension void, extending continuously from said bottle into said wet smoke cavern, positioned to allow the uniform, direct ascension of wet smoke from said bottle to said wet smoke cavern.

10. The system of claim 9 wherein said flexible seal is removably disposed about the periphery of said neck.

11. The system of claim 9 wherein said wet smoke cavern includes a perimeter diminishing upwardly with respect to said bottle.

12. The system of claim 11 wherein said stem further comprises multiple wet smoke outlets, and multiple hose fittings in fluid communication with said multiple wet smoke outlet such that each wet smoke outlet allows the passage of wet smoke to a single hose fitting.

13. The system of claim 12 wherein said multiple hose fittings are removable hose fittings with a threaded portion.

14. The system of claim 9 wherein said bottle further defines a peripheral shoulder dimensioned to support said hookah stem.

* * * * *